US007526878B2

(12) United States Patent
Sonobe et al.

(10) Patent No.: US 7,526,878 B2
(45) Date of Patent: May 5, 2009

(54) METHOD AND APPARATUS FOR DRYING COATING FILM AND METHOD FOR PRODUCING OPTICAL FILM

(75) Inventors: Masaki Sonobe, Odawara (JP); Takashi Yahiro, Minami-Ashigara (JP)

(73) Assignee: FUJIFILM Corporation, Tokyo (JP)

( * ) Notice: Subject to any disclaimer, the term of this patent is extended or adjusted under 35 U.S.C. 154(b) by 35 days.

(21) Appl. No.: 11/902,735

(22) Filed: Sep. 25, 2007

(65) Prior Publication Data

US 2008/0206455 A1 Aug. 28, 2008

(30) Foreign Application Priority Data

Sep. 25, 2006 (JP) ..... 2006-259659

(51) Int. Cl.
*F26B 3/30* (2006.01)

(52) U.S. Cl. ..... 34/266; 34/463; 34/629; 34/636; 427/162; 359/599; 425/223; 118/719

(58) Field of Classification Search ..... 34/266, 34/321, 444, 463, 629, 636; 427/162, 457, 427/558; 359/599; 118/718, 719
See application file for complete search history.

(56) References Cited

U.S. PATENT DOCUMENTS 2,394,889 A * 2/1946 Blanchard ..... 384/380
3,157,476 A * 11/1964 Smith, Jr. ..... 34/218
3,231,985 A * 2/1966 Smith, Jr. ..... 34/448
3,271,874 A * 9/1966 Oppenheimer ..... 34/292
3,591,767 A * 7/1971 Mudie ..... 219/244
3,800,432 A * 4/1974 Miyata et al. ..... 34/620
4,279,244 A * 7/1981 McAlister ..... 126/621
4,924,599 A * 5/1990 Bubley ..... 34/278
5,038,361 A * 8/1991 Wu ..... 373/119

(Continued)

FOREIGN PATENT DOCUMENTS

CA 2295934 A1 1/1999

(Continued)

OTHER PUBLICATIONS

Yuji Ozaki, "Coating Kogaku (Coating Engineering)", Asakura Shoten, 1971, p. 291-294.

*Primary Examiner*—S. Gravini
(74) *Attorney, Agent, or Firm*—Sughrue Mion, PLLC

(57) ABSTRACT

The present invention provides a method for drying a coating film comprising drying a coating film of an organic solvent-containing coating liquid applied to a running band-shaped flexible substrate, the drying method comprising the steps of: providing a heater at a position opposed to the band-shaped flexible substrate at a running position immediately after coating; and heating the band-shaped flexible substrate by the heater; wherein when $T_W$( ° C.) denotes the surface temperature of the band-shaped flexible substrate; $T_H$( ° C.) denotes the surface temperature of the heater; λ(W/m·K) denotes the heat-transfer coefficient of air; d(m) denotes the distance between the heater and the band-shaped flexible substrate (web); η denotes the efficiency of heat transfer; and σ denotes the Stefan-Boltzmann constant ($5.670\times10^{-8}$ $W/m^2K^4$), the ratio of radiant heat transfer represented by $Q_R/(Q_R+Q_C)$ is 0.25 or more and 0.6 or less, wherein $Q_C$ and $Q_R$ are represented by the following equations, respectively: $Q_C=\lambda/d\cdot(T_H-T_W)$ where $Q_C$ denotes heat transfer by air, and $Q_R=\eta\{(T_H+273)^4-(T_W+273)^4\}$ where $Q_R$ denotes heat transfer by radiant.

18 Claims, 2 Drawing Sheets

U.S. PATENT DOCUMENTS

| | | | | |
|---|---|---|---|---|
| 5,079,853 | A * | 1/1992 | Kurokawa | 34/60 |
| 5,168,639 | A | 12/1992 | Hebels | |
| 5,332,438 | A * | 7/1994 | Ueda et al. | 118/65 |
| 5,603,168 | A * | 2/1997 | McMahon, Jr. | 34/471 |
| 5,694,701 | A | 12/1997 | Huelsman et al. | |
| 5,782,974 | A * | 7/1998 | Sorensen et al. | 117/82 |
| 5,853,801 | A | 12/1998 | Suga et al. | |
| 5,876,280 | A * | 3/1999 | Kitano et al. | 454/187 |
| 6,012,858 | A * | 1/2000 | Konishi et al. | 396/611 |
| 6,398,872 | B1 * | 6/2002 | Jojiki | 118/718 |
| 6,883,250 | B1 * | 4/2005 | Aggarwal et al. | 34/433 |
| 6,957,690 | B1 * | 10/2005 | Raaijmakers | 165/80.1 |
| 7,182,813 | B2 * | 2/2007 | Endo et al. | 118/65 |
| 2002/0018862 | A1 * | 2/2002 | Tsai et al. | 427/554 |
| 2002/0031608 | A1 * | 3/2002 | Aoki | 427/377 |
| 2003/0061726 | A1 * | 4/2003 | Konrad et al. | 34/245 |
| 2004/0191419 | A1 * | 9/2004 | Oki et al. | 427/372.2 |
| 2008/0235983 | A1 * | 10/2008 | Nakamura et al. | 34/463 |

FOREIGN PATENT DOCUMENTS

| | | | |
|---|---|---|---|
| EP | 1 462 746 | A2 | 9/2004 |
| GB | 1 401 041 | | 7/1975 |
| GB | 2 242 509 | A | 10/1991 |
| JP | 48-42903 | A | 12/1973 |
| JP | 5-8372 | A | 1/1993 |
| JP | 9-73016 | A | 3/1997 |
| JP | 11-254642 | A | 9/1999 |
| JP | 2000-157923 | A | 6/2000 |
| JP | 2001-170547 | A | 6/2001 |
| JP | 2003-93953 | A | 4/2003 |
| JP | 2004-290776 | A | 10/2004 |

* cited by examiner

METHOD AND APPARATUS FOR DRYING COATING FILM AND METHOD FOR PRODUCING OPTICAL FILM

BACKGROUND OF THE INVENTION

1. Field of the Invention

The present invention relates to a method and an apparatus for drying a coating film, particularly to a method and an apparatus for drying the surface of a long and wide coating film formed by applying various liquid compositions to a continuously running band-shaped flexible substrate (hereinafter referred to as "web") and a method for producing an optical film.

2. Description of the Related Art

As a method and an apparatus for drying the surface of a long and wide coating film formed by applying various liquid compositions to a continuously running web, there is known a drying method in which a non-coated surface of the web is supported by a roll and the web is dried by blowing air onto a coated surface from an air nozzle; or a non-contact air floating drying method in which a web is dried by blowing air onto both a coated surface and a non-coated surface of the web from air nozzles in a state where the web is floating in the air (Japanese Patent Publication No. 48-042903).

In these methods of blowing air for drying (hereinafter referred to as "hot-air drying method"), drying is generally performed by blowing humidity-controlled air onto a coated surface to evaporate a solvent contained in the coated surface. Although these hot-air drying methods are superior in drying efficiency, they had a problem of failing to provide a uniform coating layer, because air is caused to blow onto the coated surface directly or via a porous plate or a straightening plate and thereby the coated surface is disturbed to make the thickness of the coating layer nonuniform to cause unevenness, and besides, the evaporation rate of the solvent at the coated surface is made uneven by convection of air to cause so-called orange peel defects (refer to Yuji Ozaki, "Coating Kogaku (Coating Engineering)", Asakura Shoten, 1971, p. 293-294) or the like.

The generation of such unevenness is remarkable especially when the coating solution contains an organic solvent. This is because, when the coating film at the initial stage of drying, which contains sufficient organic solvent, has the distribution of evaporation from the organic solvent, the surface of the coating film comes to have a temperature distribution and a surface tension distribution; as a result, there occurs an in-plane flow, such as the so-called Marangoni convection, in the coating film. This unevenness results in serious coating defects. When a liquid crystal is contained in the coating film, there was a problem such as generation of deviation in the alignment of the liquid crystal in the coating film surface by the blown air in addition to the problem of drying unevenness as described above.

As a method for solving these problems, Japanese Patent Application Laid-Open No. 2001-170547 (pages 3 to 5, FIG. 1) discloses a system in which a dryer is provided immediately after coating. Therein is disclosed a method for preventing generation of unevenness by partitioning the dryer into several parts and carrying out drying in each of the partitioned parts by blowing air from one edge to the other edge in the width direction of a substrate while controlling air velocity. For the same purpose, Japanese Patent Application Laid-Open No. 9-73016 (page 5, FIG. 5) discloses a method of placing metal gauze instead of partitioning the dryer for the same purpose.

Further, there is known a method of increasing the viscosity of a coating solution by increasing the concentration of the coating solution or by adding a thickener to the coating solution to thereby suppress a flow of the coating film surface immediately after coating by drying air, and a method of using a high boiling solution to thereby prevent generation of unevenness through leveling effect of the high boiling solution even if drying air causes flow in the coated surface immediately after coating. However, the method of increasing the viscosity of a coating solution or using a high boiling solution, as described in Japanese Patent Application Laid-Open No. 2001-170547 (pages 3 to 5, FIG. 1), had problems of bringing about a loss of suitability for high-speed coating, an increase in drying time and an extreme drop in production efficiency.

Japanese Patent Application Laid-Open No. 2000-157923 (pages 2 and 3, FIG. 1) discloses a method of controlling air velocity immediately after coating to a small value in order to prevent nonuniform drying of a coated surface by drying air. Further, GB Patent No. 1401041, U.S. Pat. Nos. 5,168,639, and 5,694,701 each disclose a method of drying a coating film without blowing air. Specifically, GB Patent No. 1401041 discloses a method of drying by evaporating a solvent in a coating solution without blowing air and recovering the solvent evaporated. According to this method, an inlet and exit for the passage of a substrate into and out of a casing are provided at the upper portion of the casing; a coating film on the substrate is dried by heating the non-coated surface of the substrate in the casing to promote the evaporation of the solvent from the coated surface; and the solvent evaporated undergoes condensation on a condenser plate disposed at the coated-surface side and is recovered in a condensed state. Further, U.S. Pat. No. 5,168,639 discloses a method of recovering a solvent by using a drum disposed above the upper side of a substrate running in a horizontal direction. Furthermore, U.S. Pat. No. 5,694,701 suggests how to improve the layout disclosed in U.S. Pat. No. 5,168,639.

However, in the method described in GB Patent No. 1401041, since a high-temperature material such as hot water is used for heating and the material is used in contact with or in the extreme vicinity of a film to be dried, the surface temperature of the film during drying rises to a significantly high temperature. This is good in terms of promotion of drying. However, in practice, when the surface temperature of the film rises to too high, a solvent from the coating film evaporates at a very high rate to facilitate generation of nonuniformity in drying, or viscosity of the coating film is reduced with the increase of temperature to thereby cause a flow in the coating film to cause unevenness. On the other hand, if a heating device is not used, the temperature of a coating film is reduced due to the evaporation of a solvent. This caused problems such as a significant reduction in drying rate in the later half of the dryer, generation of blushing phenomena and the like.

As a method for solving these problems, various methods have been proposed in which the non-coated surface of a web is heated by an infrared heater (refer to Japanese Patent Application Laid-Open Nos. 2004-290776, 2003-93953, 5-8372, and 11-254642).

For example, Japanese Patent Application Laid-Open No. 2004-290776 describes a drying method in which drying is performed by providing a dryer, at a running position immediately after coating, which is surrounded by a casing and is provided with an infrared heater for drying, and a hot-air drying device downstream of the dryer. This drying method allows efficient drying of a coating film on a band-shaped flexible substrate without causing drying unevenness in the coating film by heating it so that the difference between the coating film temperature T1 at the inlet of the dryer and the coating film temperature T2 at the outlet of the dryer comes to 5° C. or less.

SUMMARY OF THE INVENTION

However, conventional methods had a problem in that, when the amount of coating was increased or line speed was increased, drying was not completed in a drying zone to thereby cause a drying unevenness failure. In order to solve this problem, the size of the drying zone has heretofore had to be extended to upsize the apparatus.

The present invention has been made in consideration of the above situation, and provides a method and an apparatus capable of drying a coating film without causing unevenness of coating when the amount of coating is increased or line speed is increased and a method for producing an optical film.

In order to achieve the above-described object, a first aspect of the present invention provides a method for drying a coating film comprising drying a coating film of an organic solvent-containing liquid applied to a running band-shaped flexible substrate, characterized by providing a heater at a position opposed to the band-shaped flexible substrate at a running position immediately after coating and heating the band-shaped flexible substrate by the heater, wherein when $T_W$( ° C.) denotes the surface temperature of the band-shaped flexible substrate; $T_H$( ° C.) denotes the surface temperature of the heater; λ(W/m·K) denotes the heat-transfer coefficient of air; d(m) denotes the distance between the heater and the band-shaped flexible substrate (web); η denotes the efficiency of heat transfer; and σ denotes the Stefan-Boltzmann constant ($5.670\times10^{-8}$ W/m$^2$K$^4$), the ratio of radiant heat transfer represented by $Q_R/(Q_R+Q_C)$ is 0.25 or more and 0.6 or less, wherein $Q_C$ and $Q_R$ are represented by the following equations, respectively:

$$Q_C=\lambda/d\cdot(T_H-T_W)$$

where $Q_C$ denotes heat transfer by air, and $$Q_R=\eta\sigma\{(T_H+273)^4-(T_W+273)^4\}$$

where $Q_R$ denotes heat transfer by radiant.

The present inventor has focused attention on air (conductive) heat transfer in the case of bringing a heater close to a web and has obtained a finding that drying rate per unit area per unit time can be increased by utilizing this air heat transfer together with radiant heat transfer. Further, the present inventor has obtained a finding that utilization of air heat transfer without appropriate knowledge may cause unevenness of coating and drying rate can be increased without causing unevenness of coating by bringing the ratio of air heat transfer to radiant heat transfer to an appropriate value.

The first aspect of the present invention has been made on the basis of these findings. Thus, drying rate can be increased without causing unevenness of coating by bringing the ratio of radiant heat transfer to 0.25 or more and 0.6 or less.

A second aspect of the present invention is characterized in that, in the first aspect, the heater is an infrared heater which emits infrared rays having a wavelength of 1 μm or more and 15 μm or less and has an infrared emissivity of 90% or more.

In accordance with the second aspect of the present invention, heat can be efficiently supplied to the coating film on the band-shaped flexible substrate.

A third aspect of the present invention is characterized in that, in the first aspect or the second aspect, the distance between the heater and the band-shaped flexible substrate is 1 mm or more and 10 mm or less.

In accordance with the third aspect of the present invention, since air heat transfer can be positively utilized, heat can be efficiently supplied to the coating film to thereby significantly increase a drying rate.

A fourth aspect of the present invention is characterized in that, in any of the first aspect to the third aspect, the surface temperature of the heater is 80° C. or more and 130° C. or less.

In accordance with the fourth aspect of the present invention, since air heat transfer can be positively utilized, heat can be supplied to the coating film to thereby significantly increase a drying rate.

A fifth aspect of the present invention provides a method for producing an optical film characterized by producing an optical film having at least one layer of coating film dried by a drying method according to any one of the first aspect to the fourth aspect.

A sixth aspect of the present invention provides an apparatus for drying a coating film for drying a coating film of an organic solvent-containing coating liquid applied to a running band-shaped flexible substrate, characterized in that the drying apparatus comprises a heater at a position opposed to the band-shaped flexible substrate, the heater being disposed at a running position immediately after coating, wherein when $T_W$( ° C.) denotes the surface temperature of the band-shaped flexible substrate; $T_H$( ° C.) denotes the surface temperature of the heater; λ(W/m·K) denotes the heat-transfer coefficient of air; d(m) denotes the distance between the heater and the band-shaped flexible substrate (web); η denotes the efficiency of heat transfer; and σ denotes the Stefan-Boltzmann constant ($5.670\times10^{-8}$ W/m$^2$K$^4$), the ratio of radiant heat transfer represented by $Q_R/(Q_R+Q_C)$ is 0.25 or more and 0.6 or less, wherein $Q_C$ and $Q_R$ are represented by the following equations, respectively:

$$Q_C=\lambda/d\cdot(T_H-T_W)$$

where $Q_C$ denotes heat transfer by air, and $$Q_R=\eta\sigma\{(T_H+273)^4-(T_W+273)^4\}$$

where $Q_R$ denotes heat transfer by radiant.

In accordance with the sixth aspect of the present invention, it has become possible to provide a drying apparatus capable of significantly increasing the drying rate without causing unevenness of coating because the ratio of heat quantity supplied from the heater by radiant heat transfer is 0.25 or more and 0.60 or less.

A seventh aspect of the present invention is characterized in that, in the sixth aspect, the heater is an infrared heater which emits infrared rays having a wavelength of 1 μm or more and 15 μm or less and has an infrared emissivity of 90% or more.

In accordance with the seventh aspect of the present invention, heat can be efficiently supplied to the coating film on the band-shaped flexible substrate.

An eighth aspect of the present invention is characterized in that, in the sixth aspect or the seventh aspect, the distance between the heater and the band-shaped flexible substrate is 1 mm or more and 10 mm or less.

In accordance with the eighth aspect of the present invention, since air heat transfer can be positively utilized in the heat transfer from the heater to the coating film on the band-shaped flexible substrate, heat can be efficiently supplied to the coating film to thereby significantly increase a drying rate.

A ninth aspect of the present invention is characterized in that, in any of the sixth aspect to the eighth aspect, the surface temperature of the heater is 80° C. or more and 130° C. or less.

In accordance with the ninth aspect of the present invention, since air heat transfer can be positively utilized in the heat transfer from the heater to the coating film on the band-shaped flexible substrate, heat can be efficiently supplied to the coating film to thereby significantly increase a drying rate.

As used herein "organic solvent" means an organic compound having a property of dissolving substances. Examples of such an organic compound include aromatic hydrocarbons such as toluene, xylene and styrene, chlorinated aromatic hydrocarbons such as chlorobenzene and ortho-dichlorobenzene, chlorinated aliphatic hydrocarbons such as methane derivatives including monochloromethane and ethane derivatives including monochloroethane, alcohols such as methanol, isopropyl alcohol and isobutyl alcohol, esters such as methyl acetate and ethyl acetate, ethers such as ethyl ether and 1,4-dioxane, ketones such as acetone and methyl ethyl ketone, glycol ethers such as ethylene glycol monomethyl ether, alicyclic hydrocarbons such as cyclohexane, aliphatic hydrocarbons such as normal hexane, and mixtures of aliphatic and aromatic hydrocarbons.

In accordance with the present invention, since not only radiant heat transfer but also air heat transfer from the heater provided in the dryer can be utilized to thereby supply heat efficiently to the coating film on the band-shaped flexible substrate, the drying rate of the coating film can be significantly increased.

DETAILED DESCRIPTION OF THE PREFERRED EMBODIMENTS

Figure 1:
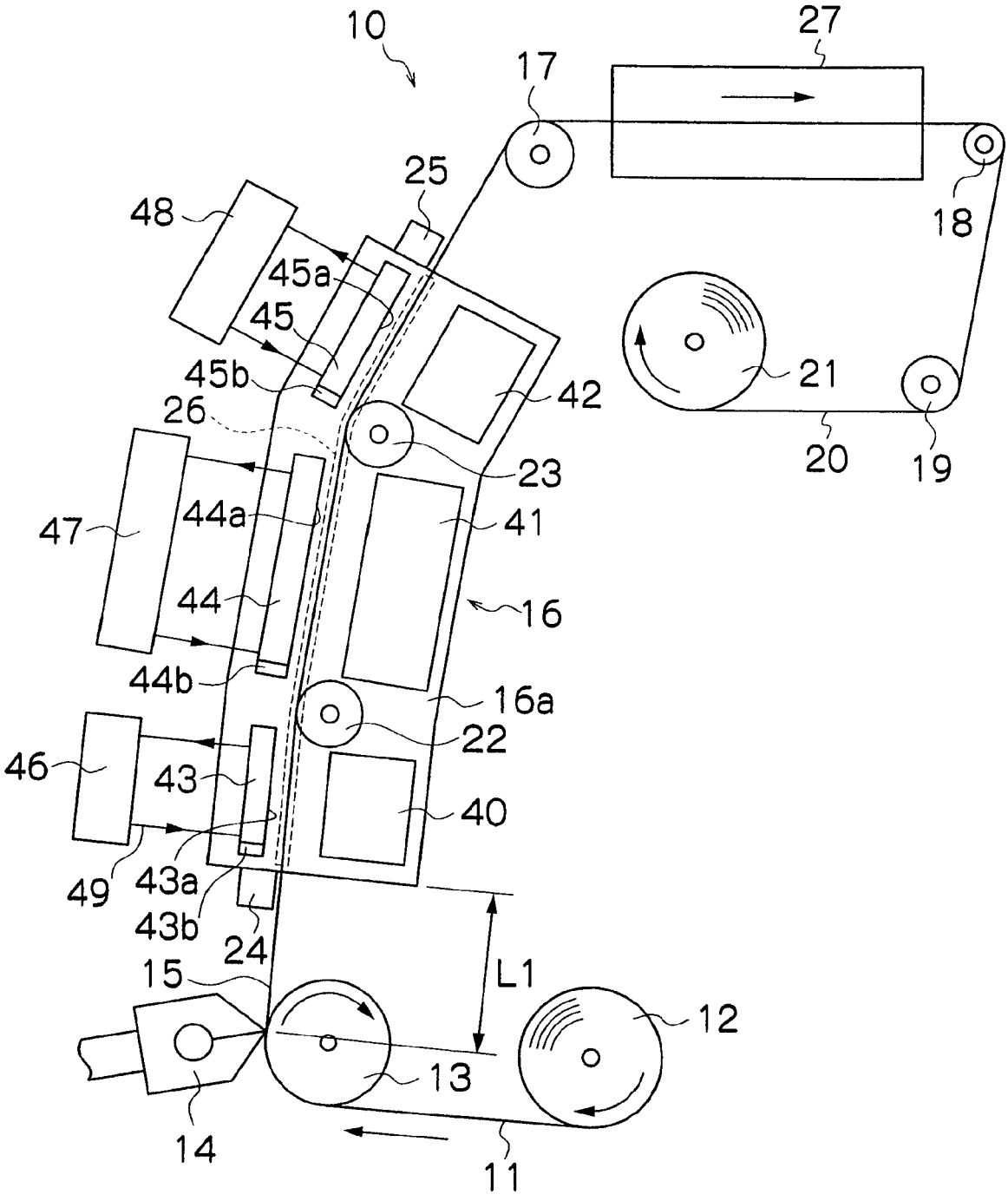
FIG. 1 is a schematic view of a coating/drying line provided with a drying apparatus according to the present invention.

Hereinafter, preferred embodiments of the method and apparatus for drying a coating film according to the present invention will be described in detail with reference to the drawings. FIG. 1 is a schematic view showing an example of a coating/drying line 10 incorporating a dryer to which the method and apparatus for drying a coating film of present invention is applied.

The coating/drying line 10 comprises a feeder 12 for feeding a web 11 wound in a roll form, a coating applicator provided with a backup roll 13 and an extrusion die 14 for applying a coating liquid to the web 11, a dryer (drying machine) 16 for drying a coating film (hereinafter also referred to as "coating layer") 15 applied to and formed on the web 11, a plurality of rolls 17, 18, and 19 which form a conveyance path through which the web (in the description hereinafter, also meaning a web on which a coating layer is formed) runs, and a winding device 21 for winding a product 20 produced through coating and drying.

Guide rolls 22 and 23 are provided in the dryer 16, and the coated web 11 is dried while running through a conveyance path formed by these guide rolls.

Note that a heater provided in the dryer 16 is preferably an infrared heater as described below.

A hot-air drying apparatus 27 is preferably provided downstream in order to further dry the coated web 11 in which drying is advanced in the dryer 16. Drying is further advanced by feeding the coated web 11 into the hot-air drying apparatus 27 while supporting the web 11 by the roll 17. Subsequently, the coated web 11, while being supported by the rolls 18 and 19, is wound by the winding device 21 as the product 20. Note that the rolls 17, 18 and 19 each may be either a free roll or a drive roll.

As the hot-air drying apparatus 27, any type of conventionally used drying apparatuses can be used, including a roller conveying dryer type apparatus in which the non-coated surface of the web is supported by a roll and the web is dried by blowing air onto the coated surface of the web from an air nozzle; a non-contact air floating dryer type apparatus in which the web is dried by blowing air onto both the coated surface and the non-coated surface of the web from an air nozzle in a state the web is floating in the air, in other words the web is not in contact with a roll and the like; and a helix drying type apparatus which is one of non-contact drying type apparatuses and can efficiently utilize space and efficiently dry a web. These drying apparatuses are common in that a coating layer is dried by dry air fed onto the surface of the coating layer.

Examples of materials which can be used for the web 11 include resin films such as PE (polyethylene), PET (polyethylene terephthalate), and TAC (cellulose triacetate), paper, and metal foil. Examples of the coating liquid include, but are not limited to, a coating liquid containing a discotic liquid crystal used for producing an optical compensation sheet and a coating liquid containing silver halide particles used for a heat developing photosensitive material. In the present invention, the coating liquid contains an organic solvent in an amount of preferably 50% by mass or more.

As the coating applicator, an applicator different from the extrusion die 14 as shown in FIG. 1 can also be used. For example, a slot die coater, a wire bar coater, a roll coater, a gravure coater, a slide hopper coating system, a curtain coating system, and the like can be used. Note that a coating device may be configured such that the coated surface faces either upward or downward with respect to the horizontal direction, or it is inclined with respect to the horizontal direction.

A dust removing device (not shown) may be disposed upstream the coating applicator, or a surface of the web 11 may be pretreated. In producing optical films for which high quality with substantially no dust is required, a high quality coated/dried film can be obtained by adopting both of the dust removing device and pretreatment.

In order to recover a vapor of an organic solvent generated from the coating layer 15, a plate-like member may also be provided at a predetermined distance from and generally parallel to the web 11. The plate-like member may be used as a straightening plate, or condenser plates 43, 44, and 45 may be used as the plate-like member. Materials used for the plate-like member include, but are not limited to, metal, plastics, and wood. However, when an organic solvent is contained in the coating liquid, it is desirable to use a material resistant to the organic solvent or to apply coating to the surface of the plate-like member.

In order to dry the coating layer 15 without causing unevenness of coating, the coating layer 15 needs to be temperature-controlled so as to control the drying rate thereof. For example, a heat exchanger type device may be used, in which coolers 46, 47, and 48 are connected to the condenser plates 43, 44, and 45, respectively, for circulating a coolant 49 through the condenser plates 43, 44, and 45. However, cooling method is not limited to a method of a heat exchanger type and includes an air cooling type using air and a type using electricity, for example, a type using the Peltier element.

A method for recovering a solvent condensed on the condenser plates 43, 44, and 45 preferably includes grooving condensing surfaces 43*a*, 44*a*, and 45*a* of the condenser plates. The grooving provides a recess and protrusion along a web conveying direction of the condensing surfaces 43*a* to 45*a*. Either the recess or the protrusion forms a channel for a solvent, thereby making it easy to recover the solvent. Further, troughs 43*b*, 44*b*, and 45*b* for recovering condensed solvent are provided at the lower part of the right end of the condenser plate, and the solvent is recovered through the troughs 43*b* to 45*b*. Thus, the coating layer 15 can be dried while keeping the solvent vapor in the vicinity of the coating layer 15 at a high concentration by controlling the condensation and recovery capability of the organic solvent evaporated from the coating layer 15. As a result, it is possible to suppress deformation of the web 11 and the coating layer 15 due to the rapid evaporation of the organic solvent. Other than the configuration for adopting a condenser plate, which is a plate-like member, it is also possible to adopt a configuration having a similar function, for example, a configuration using a porous plate, a net, a drainboard, a roll, or the like. Furthermore, a recovery device as disclosed in U.S. Pat. No. 5,694,701 may be used in combination with the condenser plates.

For determining the temperature of the web 11, the coating layer 15, and the condenser plate, a care should be taken so as to prevent condensation of the evaporated solvent on locations other than the condenser plate, for example, on the surface of a roll. For this purpose, it is possible to avoid such condensation by, for example, keeping the parts other than the condenser plate at a temperature higher than that of the condenser plate.

The dryer 16 is covered with a casing 16*a*, which seals the dryer except for the inlet and outlet thereof so as to prevent intake and exhaust of the air in the dryer 16. In the drying of the coating layer 15, the casing can prevent air disturbance in the vicinity of the coated surface. Further, the dryer 16 is preferably disposed as close to the coating position as possible in order to prevent drying unevenness of the coating layer 15 due to the generation of natural convection immediately after the coating liquid is coated. Specifically, the dryer 16 is more preferably disposed such that the spacing L1 from the coating position to the inlet of the dryer 16 is 2 m or less, most preferably 0.7 m or less.

For the same reason, the running speed of the web 11 is preferably set at a speed at which the web 11 reaches the dryer 16 within 3 seconds after the coating by the coating applicator.

In general, when the amount of the coating liquid or the thickness of the coating layer is larger, unevenness is liable to occur since a flow in the interior of the coating layer is liable to occur. However, according to the present invention, the coating layer 15 can be dried at a high drying rate without causing drying unevenness because the coating layer 15 can be efficiently supplied with heat in the dryer 16 even when the amount of the coating liquid or the thickness of the coating layer is large. In particular, when the coating layer 15 has a wet coating thickness in the range of 3 μm or more and 50 μm or less, it is possible to dry the coating layer without causing unevenness and with high efficiency. Note that "wet coating thickness" as described herein means the total coating thickness imparted to a web during coating.

Moreover, when the running speed of the web 11 is too high, the boundary layer in the vicinity of the coating layer is disturbed by the accompanied wind to adversely affect the coating layer, and also the coating layer cannot be dried sufficiently in the dryer 16. Accordingly, the running speed of the web 11 is preferably set at 10 m/min or more and 100 m/min or less. Since the drying unevenness of the coating layer 15 is liable to occur in the initial period of drying, it is preferred that 70% by mass or more of the organic solvent in the coating liquid is evaporated, condensed, and recovered by the dryer 16 and the organic solvent in the remaining coating liquid is evaporated in the hot-air drying apparatus 27. What percentage in mass of the organic solvent in the coating liquid is to be evaporated may be determined by totally judging the influence to the drying unevenness of the coating layer 15, production efficiency, and the like.

Figure 2:
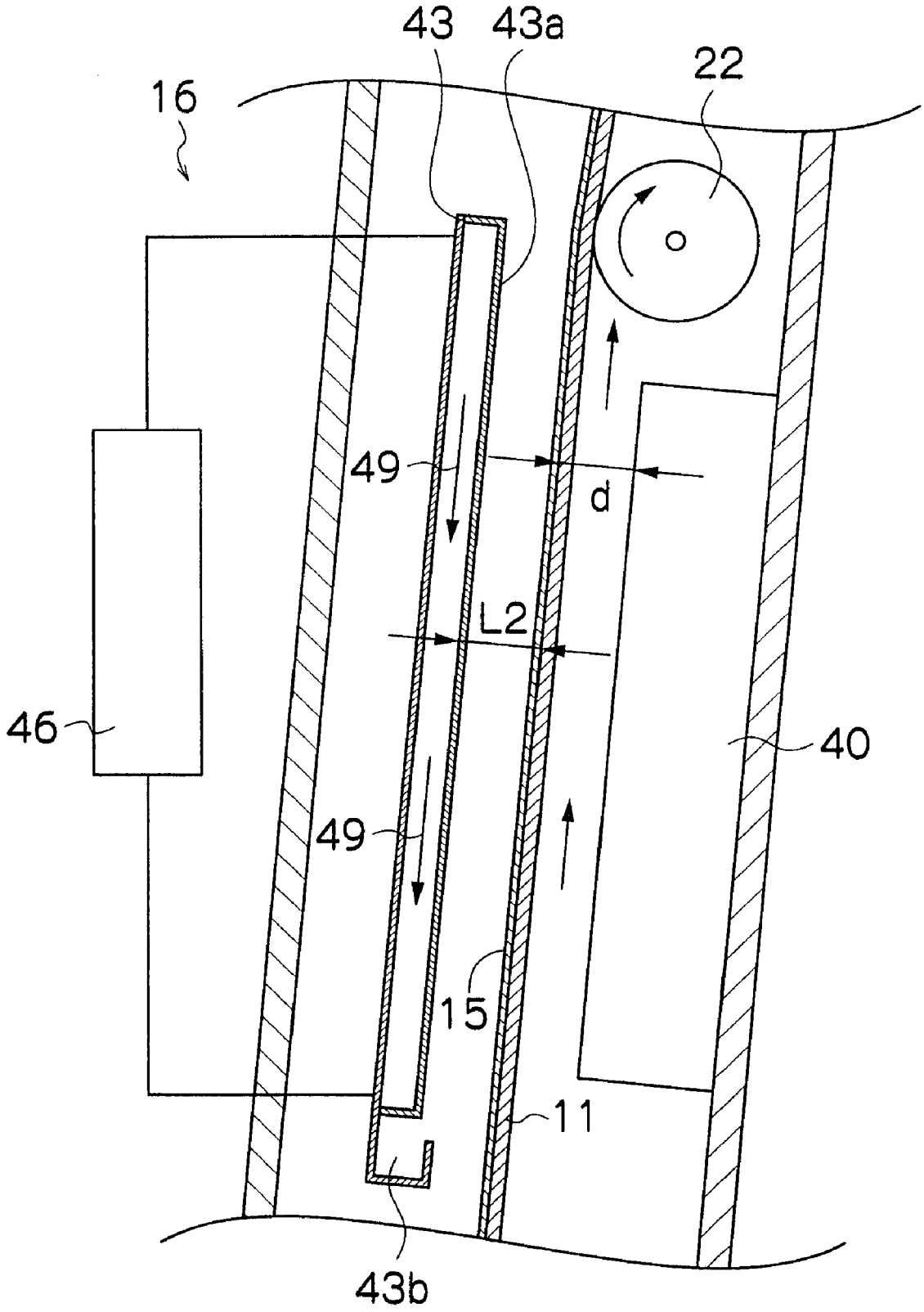
FIG. 2 is a sectional view of the main part of the drying apparatus shown in FIG. 1.

FIG. 2 shows a sectional view of the main part of the dryer 16, and a method for drying the coated web 11 and a method for recovering the evaporated organic solvent will be described below. In order to promote condensation of the organic solvent evaporated from the coating layer 15, the condenser plates 43 to 45 are preferably cooled for condensation and recovery of the organic solvent. The distance (spacing) L2 between the surface of the coating layer 15 and the surface of the condenser plate 43*a* needs to be adjusted to an appropriate distance in consideration of a desired drying rate of the coating layer 15. A shorter distance may increase the drying rate, but the drying rate may be easily influenced by the accuracy of a set distance. In addition, the possibility of the surface of the coating layer 15 becoming in contact with the surface of the condenser plate 43*a* may increase. On the other hand, a larger distance L2 may not only significantly reduce the drying rate but also cause natural convection due to heat to thereby cause drying unevenness. Therefore, in the present invention, the distance L2 between the surface of the coating layer 15 and the surface of the condenser plate is preferably 5 mm or more and 10 mm or less. Note that other condenser plates 44 and 45 preferably have the same configuration.

As shown in FIG. 2, a heater 40 is provided in the dryer 16 such that the heater 40 is opposed to the surface of the web 11 on which the coating liquid is not coated. The heater 40 supplies heat to the coating layer 15 on the web 11 conveyed in the dryer 16 to thereby evaporate the solvent contained in the coating layer 15 to dry the coating layer 15.

The heater 40 is preferably an infrared heater which emits infrared rays having a wavelength of 1 μm or more and 15 μm or less and has an infrared emissivity of 90% or more.

Further, the heater 40 preferably has the shape of a flat heater.

Since the surface temperature $T_H$(° C.) of the heater 40 is higher than the surface temperature $T_W$(° C.) of the coating layer 15 on the web 11, heat transfers from the heater 40 to the coating layer 15.

Here, the heat quantity $Q_R$ transferred by radiant heat transfer to the coating layer 15 is represented by the following equation (1) using the surface temperature $T_H$(° C.) of the heater 40 and the surface temperature $T_W$(° C.) of the web 11:

$$Q_R=\eta\sigma((T_H+273)^4-(T_W+273)^4) \quad \text{(Equation 1)}$$

wherein σ denotes the Stefan-Boltzmann constant ($5.670\times 10^{-8}$ W/m$^2$K$^4$); and η denotes the efficiency of heat transfer (thermal emissivity).

Further, the heat quantity $Q_C$ transferred by air (conductive) heat transfer to the coating layer 15 is represented by the following equation (2) using the surface temperature $T_H$(° C.) of the heater 40, the surface temperature $T_W$(° C.) of the web 11, and the distance d(m) between the web 11 and the heater 40:

$$Q_C=\lambda(T_H-T_W)/d \quad \text{(Equation 2)}$$

wherein λ is the heat-transfer coefficient (W/K) of air.

In the present invention, the distance d(m) between the web 11 and the heater 40 and the surface temperature $T_H$(° C.) of the heater 40 are adjusted so that the ratio $((Q_R)/(Q_R+Q_C))$ of the heat quantity ($Q_R$) transferred by radiant heat transfer from the heater 40 to the coating layer 15 to the total heat quantity ($Q_R+Q_C$) transferred from the heater 40 to the coating layer 15 is 0.25 or more and 0.60 or less. This ensures efficient heat transfer from the heater 40 to the coating layer 15 on the web 11 and allows significant increase in the drying rate of the coating layer 15. The value of the $((Q_R)/(Q_R+Q_C))$ is preferably 0.30 or more and 0.50 or less, more preferably 0.35 or more and 0.45 or less.

The distance d(m) between the web 11 and the heater 40 is preferably 1 mm or more and 10 mm or less. The reason is as follows: When the distance is less than 1 mm, the ratio of the heat quantity supplied by the air heat transfer to the total heat quantity supplied from the heater 40 to the coating layer 15 becomes too large, thereby causing a streak failure on the coating layer 15 after drying, and when the distance exceeds 10 mm, the ratio of the heat quantity supplied by the air heat transfer to the total heat quantity supplied from the heater 40 to the coating layer 15 becomes too small to efficiently supply heat to the coating layer 15, thereby causing drying unevenness.

Further, in the present invention, the surface temperature $T_H$( ° C.) of the heater 40 is preferably 80° C. or more and 130° C. or less. The reason is as follows: When the temperature is less than 80° C., the ratio of the heat quantity supplied by the air heat transfer to the total heat quantity supplied from the heater 40 to the coating layer 15 becomes too small to efficiently supply heat to the coating layer 15, thereby causing drying unevenness, and when the surface temperature exceeds 130° C., the ratio of the heat quantity supplied by the air heat transfer becomes too large, thereby causing a streak failure on the coating layer after drying.

Other heaters 41 and 42 are preferably constructed in the same configuration.

The length of the casing 16*a* can be freely determined without any limitation on conveyance by arranging a plurality of guide rolls 22 and 23 in the dryer 16. When the guide rolls 22 and 23 are heated by the heaters 40 to 42 to excessively increase the temperature of the rolls, the guide rolls 22 and 23 are desirably jacketed to allow temperature control.

The configuration of the dryer 16 which is the drying apparatus of the present invention is not limited to the illustrated configuration. Moreover, conventional members can be used in the feeder, rolls, winding device, and the like used in the coating/drying line incorporating the drying apparatus applied with the method and apparatus for drying a coating film of the present invention. Accordingly, the description thereof is omitted.

The drying method according to an embodiment of the present invention as described above has allowed increase in a drying rate without causing unevenness of coating by bringing the ratio between air heat transfer and radiant heat transfer to an appropriate value when a solvent in the coating layer 15 applied to the web 11 is condensed and recovered by applying heat from the heater 40 provided in the dryer 16. Specifically, it has become possible to efficiently supply heat to a solvent in the coating layer 15 by bringing the ratio of the heat quantity supplied by radiant heat transfer from the heater 40 to the total heat quantity supplied from the heater 40 to 0.25 or more and 0.60 or less. Thus, it has become possible to significantly increase a drying rate.

The method and apparatus for drying a coating film according to the present invention provide the same effect even when applied to a solution or dispersion obtained by mixing solids such as polymers or particles in a coating liquid. It is preferred to apply the present invention to such a system because in a system containing particles or the like, generation of drying unevenness significantly influences the dispersion and distribution of particles in the coating film.

The present invention is suitably used in the production of optical functional films and sheets such as optical compensation sheets, solvent-based undercoat for films for photosensitive materials, heat developing photosensitive materials, functional films containing fine-structured particles such as nanoparticles, photographic films, photographic paper, magnetic recording tapes, adhesive tapes, pressure sensitive recording paper, offset plate materials, batteries, and the like.

EXAMPLES

Example 1

In the step of drying a coating layer in a production line of an optical compensation sheet, there was provided, at a running position immediately after coating, a dryer 16 covered with a casing to prevent air disturbance in the vicinity of the coated surface, and heating conditions in the dryer 16 suitable for producing the optical compensation sheet was studied.

In the production line, the optical compensation sheet is produced, for example, according to the following steps:

1) the step of feeding a transparent film;
2) the step of forming an alignment film-forming resin layer, wherein a coating liquid containing an alignment film-forming resin is applied to a surface of a transparent film and dried;
3) a rubbing step of subjecting the surface of the resin layer to rubbing treatment to form an alignment film on the transparent film with the alignment film-forming resin layer formed on the surface thereof;
4) the step of coating a liquid crystalline discotic compound, wherein a coating liquid containing the liquid crystalline discotic compound is coated on the alignment film;
5) the step of drying the coating film by evaporating a solvent in the coating film;
6) a liquid crystal layer-forming step of heating the coating film to a discotic nematic phase-forming temperature to form a liquid crystal layer of the discotic nematic phase;
7) the step of solidifying the liquid crystal layer (specifically, rapidly cooling the liquid crystal layer after it is formed to thereby solidify it, or photoirradiating (or heating) the liquid crystal layer to thereby crosslink it when a liquid crystalline discotic compound having a crosslinkable functional group is used); and
8) the step of winding the transparent film on which the alignment film and the liquid crystal layer are formed.

The optical compensation film was produced continuously from the step of feeding a long transparent film through the step of winding the optical compensation sheet obtained. A long film of triacetyl cellulose (Fujitac, manufactured by Fujifilm, Corporation, thickness: 100 μm, width: 500 nm) was coated with a 5% by weight long chain alkyl-modified poval (MP-203, manufactured by Kuraray Co., Ltd., note: poval is a registered trademark) solution on one side, dried at 90° C. for 4 minutes, and then subjected to rubbing treatment to form an alignment film-forming resin layer having a thickness of 2.0 μm. The conveying speed of the film was 80 m/min.

In the above-described triacetyl cellulose film, when the refractive index in two perpendicular directions in the film plane is defined as nx and ny; the refractive index in the thickness direction is defined as nz; and the thickness of the film is defined as d, the following equations were obtained: $(nx-ny)\times d=16$ nm, and $\{(nx-ny)/2-nz\}\times d=75$ nm. Further, the above-described alignment film-forming resin layer was formed through the coating/drying line provided with the dryer 16 according to the present invention.

Subsequently, the surface of the resin layer was subjected to rubbing treatment while continuously conveying the obtained film having a resin layer thereon at a conveying speed of 60 m/min. The rubbing treatment was performed at a rotation number of the rubbing roller of 300 rpm, followed by removing dust on the resulting alignment film.

Then, while continuously conveying the obtained film having an alignment film thereon at a speed of 60 m/min, a 10% by weight methyl ethyl ketone solution (coating liquid) of a mixture obtained by adding 1% by weight of a photoinitiator (Irgacure 907, manufactured by Ciba Geigy Japan Limited) to a mixture of discotic compounds TE-(1) and TE-(2) shown in Chemical Formula 1 mixed at a weight ratio of 4:1 based on the discotic compound mixture was applied to the alignment film by an extrusion die coating machine at a coating speed of 60 m/min and a coating amount of 10 cc/$m^2$. The film was then introduced into the drying zone three seconds after the coating.

Infrared heaters 40, 41, and 42 were installed in the dryer 16 which constitutes a drying zone, wherein the infrared heaters emit infrared rays having a wavelength of from 1 μm to 15 μm and have an infrared emissivity of 90% or more. The surface temperature of the web 11 was maintained at 25° C., and the surface temperature of the infrared heaters 40, 41, and 42 was set at 80° C. The spacing between the web 11 and the infrared heaters 40, 41, and 42 was set at 1.5 mm. With respect to the heat transferred from the infrared heaters 40, 41, and 42 to the coating layer on the web 11, the heat quantity $Q_C$ transferred by air heat transfer was calculated to be 1,000 W/$m^2$, when 0.03 (W/m·K) was used as the heat-transfer coefficient of air, λ. The heat quantity $Q_R$ transferred by radiant heat transfer was then calculated to be 338 W/$m^2$, when 0.78 was used as the efficiency of heat transfer, η. Next, the ratio of the heat quantity $Q_R$ supplied by radiant heat transfer to the coating layer 15 to the total heat quantity (sum of $Q_R$ and $Q_C$) supplied from the infrared heaters 40, 41, and 42 to the coating layer 15 was calculated to be 0.25.

Then, the web 11 was conveyed into a heating zone adjusted at 130° C. three seconds after it was passed through the drying zone and was passed through the heating zone in about three minutes.

[Chemical Formula 1]

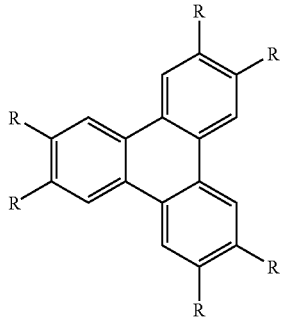

TE

-continued (1)

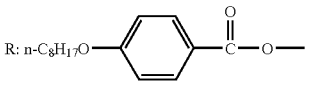

(2)

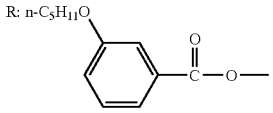

Subsequently, while continuously conveying the film with an alignment film and a liquid crystal layer coated thereon at a conveying speed of 60 m/min, the surface of the liquid crystal layer was irradiated with ultraviolet light by an ultraviolet lamp. More specifically, the film which has passed through the heating zone was irradiated with ultraviolet light at an illuminance of 600 mW by an ultraviolet irradiation apparatus (ultraviolet lamp: output 160 W/cm, light emission length: 1.6 m) for four seconds to crosslink the liquid crystal layer.

Other Examples

In Examples 2 to 10 and Comparative Examples 1 to 10, optical compensation sheets were produced in the same manner as in Example 1 except that the surface temperature of the infrared heaters 40, 41, and 42 and the spacing between the web 11 and the infrared heaters 40, 41, and 42 were set as shown in Table 1.

The resulting optical compensation sheets were evaluated according to the following criteria:

- A particularly uniform quality of coating was obtained without generation of drying unevenness: excellent,
- A uniform quality of coating was obtained without generation of drying unevenness: good, and
- A uniform quality of coating was not obtained due to the development of disturbance in a coated surface caused by drying unevenness: poor.

Table 1 shows production conditions and evaluation results of these optical compensation sheets.

TABLE 1

| | Surface temperature of web (° C.) | Surface temperature of infrared heater (° C.) | Spacing between infrared heater and web (mm) | $Q_R$ (W/$m^2$) | $Q_C$ (W/$m^2$) | $Q_R/(Q_R+Q_c)$ (W/$m^2$) | Evaluation | Surface state of optical compensation sheet |
|---|---|---|---|---|---|---|---|---|
| Example 1 | 25 | 80 | 1.5 | 338 | 1100 | 0.25 | good | uniform |
| Example 2 | 25 | 80 | 2 | 338 | 825 | 0.30 | excellent | particularly uniform |
| Example 3 | 25 | 80 | 3 | 338 | 550 | 0.38 | excellent | particularly uniform |
| Example 4 | 25 | 100 | 3 | 507 | 750 | 0.40 | excellent | particularly uniform |
| Example 5 | 25 | 130 | 3 | 818 | 1050 | 0.44 | excellent | particularly uniform |
| Example 6 | 25 | 85 | 5 | 378 | 360 | 0.50 | excellent | particularly uniform |
| Example 7 | 25 | 80 | 5 | 338 | 330 | 0.51 | good | uniform |

TABLE 1-continued

| | Surface temperature of web (° C.) | Surface temperature of infrared heater (° C.) | Spacing between infrared heater and web (mm) | $Q_R$ (W/m$^2$) | $Q_C$ (W/m$^2$) | $Q_R/(Q_R+Q_c)$ (W/m$^2$) | Evaluation | Surface state of optical compensation sheet |
|---|---|---|---|---|---|---|---|---|
| Example 8 | 25 | 100 | 5 | 507 | 450 | 0.53 | good | uniform |
| Example 9 | 25 | 130 | 5 | 818 | 630 | 0.56 | good | uniform |
| Example 10 | 25 | 130 | 6 | 818 | 525 | 0.60 | good | uniform |
| Comparative Example 1 | 25 | 80 | 1 | 338 | 1650 | 0.17 | poor | nonuniform |
| Comparative Example 2 | 25 | 100 | 1 | 507 | 2250 | 0.18 | poor | nonuniform |
| Comparative Example 3 | 25 | 130 | 1 | 818 | 3150 | 0.21 | poor | nonuniform |
| Comparative Example 4 | 25 | 40 | 10 | 76 | 45 | 0.63 | poor | nonuniform |
| Comparative Example 5 | 25 | 80 | 10 | 338 | 165 | 0.67 | poor | nonuniform |
| Comparative Example 6 | 25 | 80 | 30 | 338 | 55 | 0.86 | poor | nonuniform |
| Comparative Example 7 | 25 | 50 | 30 | 133 | 25 | 0.84 | poor | nonuniform |
| Comparative Example 8 | 25 | 130 | 30 | 818 | 105 | 0.89 | poor | nonuniform |
| Comparative Example 9 | 25 | 40 | 50 | 76 | 9 | 0.89 | poor | nonuniform |
| Comparative Example 10 | 25 | 80 | 50 | 338 | 33 | 0.91 | poor | nonuniform |

CONCLUSION

As shown in Table 1, generation of streak failure caused by drying unevenness was not observed in Examples 1 to 10. In particular, as shown in Examples 2 to 6, when the ratio of the heat quantity supplied by radiant heat transfer to the coating layer 15 to the total heat quantity supplied from the infrared heaters 40, 41, and 42 to the coating layer 15 was from 0.30 to 0.50, it was found that generation of drying unevenness was not observed and a film having a particularly uniform quality of coating was obtained.

Further, as shown in Table 1, it is apparent that, in Comparative Examples 1 to 10, streak failure caused by drying unevenness was observed in the resulting films and only films with poor surface quality was obtained.

What is claimed is:

1. A method for drying a coating film comprising drying a coating film of an organic solvent-containing coating liquid applied to a running band-shaped flexible substrate, the drying method comprising the steps of:

providing a heater at a position opposed to the band-shaped flexible substrate at a running position immediately after coating; and heating the band-shaped flexible substrate by the heater; wherein when $T_W$(° C.) denotes the surface temperature of the band-shaped flexible substrate; $T_H$(° C.) denotes the surface temperature of the heater; λ(W/m·K) denotes the heat-transfer coefficient of air; d(m) denotes the distance between the heater and the band-shaped flexible substrate (web); η denotes the efficiency of heat transfer; and η denotes the Stefan-Boltzmann constant (5.670×10$^{-8}$ W/m$^2$K$^4$), the ratio of radiant heat transfer represented by $Q_R/(Q_R+Q_C)$ is 0.25 or more and 0.6 or less, wherein $Q_C$ and $Q_R$ are represented by the following equations, respectively:

$$Q_C=\lambda/d\cdot(T_H-T_W)$$

where $Q_C$ denotes heat transfer by air, and $$Q_R=\eta\sigma\{(T_H+273)^4-(T_W+273)^4\}$$

where $Q_R$ denotes heat transfer by radiant.

2. The drying method according to claim 1, wherein the heater is an infrared heater which emits infrared rays having a wavelength of 1 μm or more and 15 μm or less and has an infrared emissivity of 90% or more.

3. The drying method according to claim 1, wherein the distance between the heater and the band-shaped flexible substrate is 1 mm or more and 10 mm or less.

4. The drying method according to claim 2, wherein the distance between the heater and the band-shaped flexible substrate is 1 mm or more and 10 mm or less.

5. The drying method according to claim 1, wherein the surface temperature of the heater is 80° C. or more and 130° C. or less.

6. The drying method according to claim 2, wherein the surface temperature of the heater is 80° C. or more and 130° C. or less.

7. The drying method according to claim 3, wherein the surface temperature of the heater is 80° C. or more and 130° C. or less.

8. A method for producing an optical film comprising producing an optical film having at least one layer of a coating film dried by a drying method according to claim 1.

9. A method for producing an optical film comprising producing an optical film having at least one layer of a coating film dried by a drying method according to claim 2.

10. A method for producing an optical film comprising producing an optical film having at least one layer of a coating film dried by a drying method according to claim 3.

11. An apparatus for drying a coating film for drying a coating film of an organic solvent-containing coating liquid applied to a running band-shaped flexible substrate, the drying apparatus comprising a heater at a position opposed to the band-shaped flexible substrate, the heater being disposed at a running position immediately after coating, wherein when $T_W$( ° C.) denotes the surface temperature of the band-shaped flexible substrate; $T_H$( ° C.) denotes the surface temperature of the heater; λ(W/m·K) denotes the heat-transfer coefficient of air; d(m) denotes the distance between the heater and the band-shaped flexible substrate (web); η denotes the efficiency of heat transfer; and σ denotes the Stefan-Boltzmann constant ($5.670\times10^{-8}$ $W/m^2K^4$), the ratio of radiant heat transfer represented by $Q_R/(Q_R+Q_C)$ is 0.25 or more and 0.6 or less, wherein $Q_C$ and $Q_R$ are represented by the following equations, respectively:

$$Q_C=\lambda/d\cdot(T_H-T_W)$$

where $Q_C$ denotes heat transfer by air, and $$Q_R=\eta\sigma\{(T_H+273)^4-(T_W+273)^4\}$$

where $Q_R$ denotes heat transfer by radiant.

12. The drying apparatus according to claim 11, wherein the heater is an infrared heater which emits infrared rays having a wavelength of 1 μm or more and 15 μm or less and has an infrared emissivity of 90% or more.

13. The drying apparatus according to claim 11, wherein the distance between the heater and the band-shaped flexible substrate is 1 mm or more and 10 mm or less.

14. The drying apparatus according to claim 12 wherein the distance between the heater and the band-shaped flexible substrate is 1 mm or more and 10 mm or less.

15. The drying apparatus according to claim 11, wherein the surface temperature of the heater is 80° C. or more and 130° C. or less.

16. The drying apparatus according to claim 12, wherein the surface temperature of the heater is 80° C. or more and 130° C. or less.

17. The drying apparatus according to claim 13, wherein the surface temperature of the heater is 80° C. or more and 130° C. or less.

18. The drying apparatus according to claim 14, wherein the surface temperature of the heater is 80° C. or more and 130° C. or less.

* * * * *